US008083550B2

(12) United States Patent
Zhu

(10) Patent No.: US 8,083,550 B2
(45) Date of Patent: Dec. 27, 2011

(54) ELECTRICAL CONNECTOR WITH COVER

(75) Inventor: Yu Zhu, ShenZhen (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 12/380,710

(22) Filed: Mar. 2, 2009

(65) Prior Publication Data

US 2009/0221161 A1 Sep. 3, 2009

(30) Foreign Application Priority Data

Feb. 29, 2008 (CN) ..... 2008 2 0032409

(51) Int. Cl.
*H01R 31/00* (2006.01)
*H01R 33/00* (2006.01)

(52) U.S. Cl. ..... 439/638

(58) Field of Classification Search ..... 439/78, 439/638, 79, 626, 650, 651, 655
See application file for complete search history.

(56) References Cited

U.S. PATENT DOCUMENTS 7,494,383 B2 * 2/2009 Cohen et al. ..... 439/638
* cited by examiner

*Primary Examiner* — Felix O Figueroa
(74) *Attorney, Agent, or Firm* — Wei Te Chung; Andrew C. Cheng; Ming Chieh Chang

(57) ABSTRACT

An electrical connector assembly includes a male connector and a female connector. The male connector includes a body having a male mating face, a first abutment face and a first mounting face and a number of first contacts each of which has a first male engaging section, a first median portion, and the first tail portion. A female connector includes a body having a female mating face, a second abutment face, and a second mounting face and a number of second contacts each of which has a first female engaging section, and a second male engaging section. A protective cover disposed on a top region between the female connector and the male connector has a projection, which abuts against the first median section of at least one of the first contact.

14 Claims, 10 Drawing Sheets

ELECTRICAL CONNECTOR WITH COVER

BACKGROUND OF THE INVENTION

1. Field of the invention

The present invention relates to an electrical connection device, and more particularly to an electrical connector assembly having two opposite interconnecting interfaces adapted to respectively interconnect to a female connector of a backplane and a male connector of an electrical device.

2. Description of Related Art

U.S. Pat. No. 6,071,150 issued to Hon Hai Precision Ind. Co., Ltd on Jun. 6, 2000, discloses an electrical connector assembly including a male section and a female section assembled together to be coupled between a female connector on a backplane in the computer and a male connector on a hard drive for establishing signal transmission between the hard drive and the backplane through the interconnections of such male and female sections. Specifically, the female section defines a female interface adapted for mating with the male connector from the hard drive, the male section defines an opposite male interface adapted to mate with the female connector from the backplane of the computer, and a plurality of contact terminals are configured to extend from the female interface towards the male interface for electrically connecting the female section with the male section. This configuration typically enables the female or male interface to supply one voltage for the male connector of the hard drive, or the female connector of the backplane.

The present problem the users confront is that the female or male interface substantially requires an electronic device of a first predetermined voltage to be equipped therewith, while the electronic component available for the users has a second predetermined voltage. In other words, the conventional configuration has no capability to provide a flexible connection to different types of electronic devices, which may require voltages of different amounts.

A pertinent application entitled electrical connector assembly having an application Ser. No. 11/810,814 filed on Jun. 7, 2007, which is assigned to a common assignee with the current invention, discloses a mating interface of an extender that is supplied two different working voltages, which indeed meets the current requirements. The extender includes a first connector having a mating face and a mounting face, and a second connector having a mating surface and a mounting surface. The mounting face and the mounting surface are disposed adjacent a printed circuit board, which is capable of providing different predetermined voltages. A first group of contact terminals is adapted to extend from the mating face of the first connector toward the mating surface of the second connector. A second group of contact terminals is adapted to extend from the mating face towards the mounting face of the first connector. A third group of contact terminals is adapted to extend from the mating surface towards the mounting surface of the second connector. Due to the printed circuit board of providing two predetermined voltage for the first connector and/or the second connector, the mating face or the mating surface is capable of being coupled to the electronic devices of requiring different predetermined voltages. Thus, the electrical connector assembly provides a flexible connection to any commodity devices of different predetermined voltages. However, when the electrical connector assembly is mounted onto a printed circuit board, the second and third groups of contact terminals are easy to be deformed.

Hence, an improved electrical connector is required to overcome the disadvantages of the prior art.

SUMMARY OF THE INVENTION

Accordingly, an object of the present invention is to provide an electrical connector assembly with a improved cover to enhance steadiness of contacts when assembled to a printed circuit board.

In order to achieve the above-mentioned object, an electrical connector assembly comprises a male connector and a female connector. The male connector comprise a body having a male mating face, a first abutment face and a first mounting face and a plurality of first contacts each having a first male engaging section adjacent the male mating face, a first median portion extending from the first engaging section and beyond said first abutment face, and the first tail portion extending towards the first mounting face. A female connector comprises a body having a female mating face, a second abutment face opposite to said first abutment face of the male connector, and a second mounting face and a plurality of second contacts each having a first female engaging section adjacent the female mating face, and a second male engaging section adjacent the male mating face. A protective cover disposed on a top region between the female connector and the male connector has at least a first projection which abuts against the first median section of at least one of the first contact.

Other objects, advantages and novel features of the present invention will become more apparent from the following detailed description of the present embodiment when taken in conjunction with the accompanying drawings.

DETAILED DESCRIPTION OF THE INVENTION

Referring to FIG. 1 to 4, an interconnection system according to an embodiment of the present invention is shown to include a printed circuit board 1, and an electrical connector assembly including a female connector 2 and a male connector 3 assembled together to be electrical connection to the printed circuit board 1.

Figure 1:
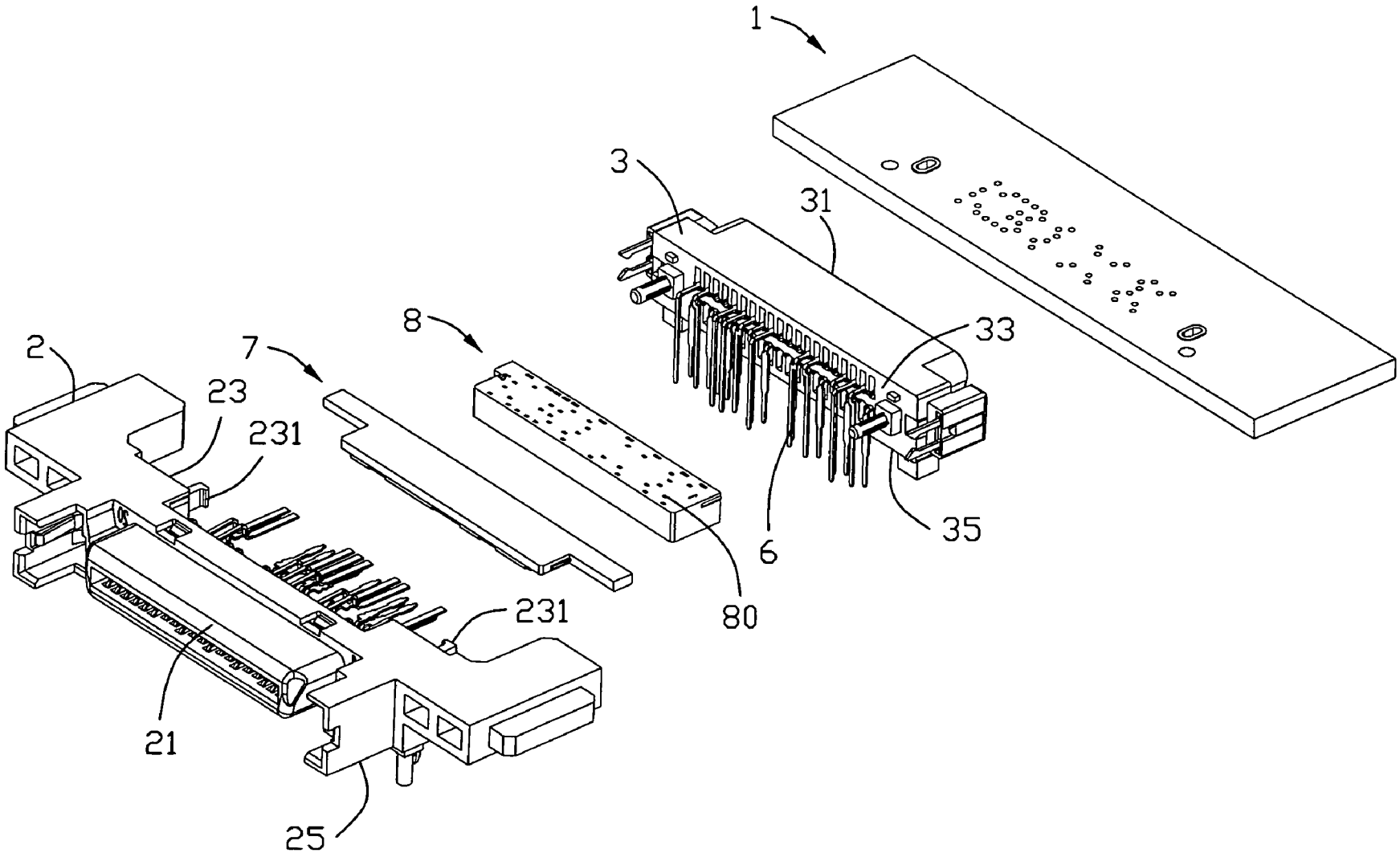
FIG. 1 is an exploded, perspective view of an interconnection system according to an embodiment of the present invention.
Figure 2:
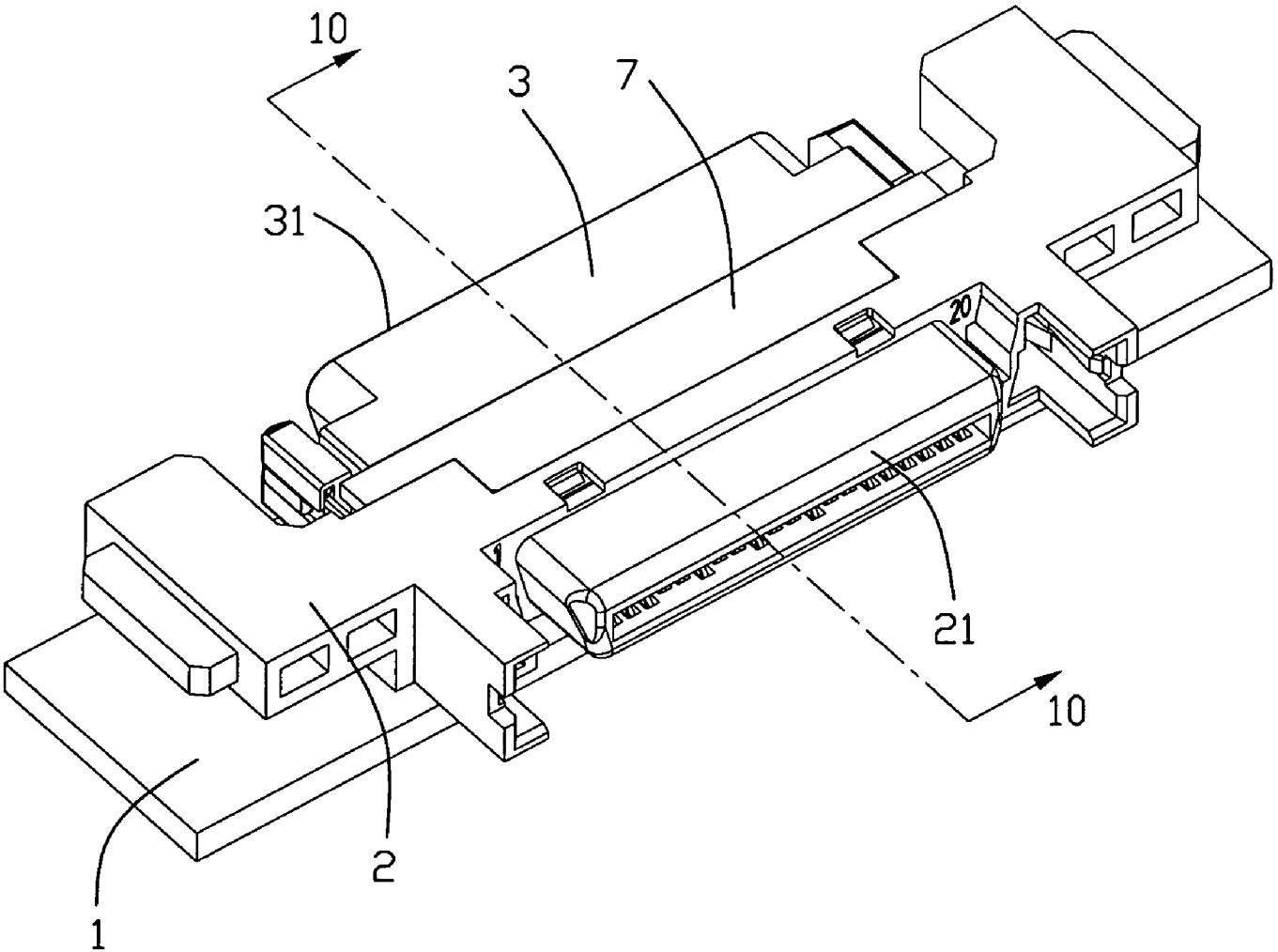
FIG. 2 is an assembled, perspective view of the interconnection system of FIG. 1.
Figure 3:
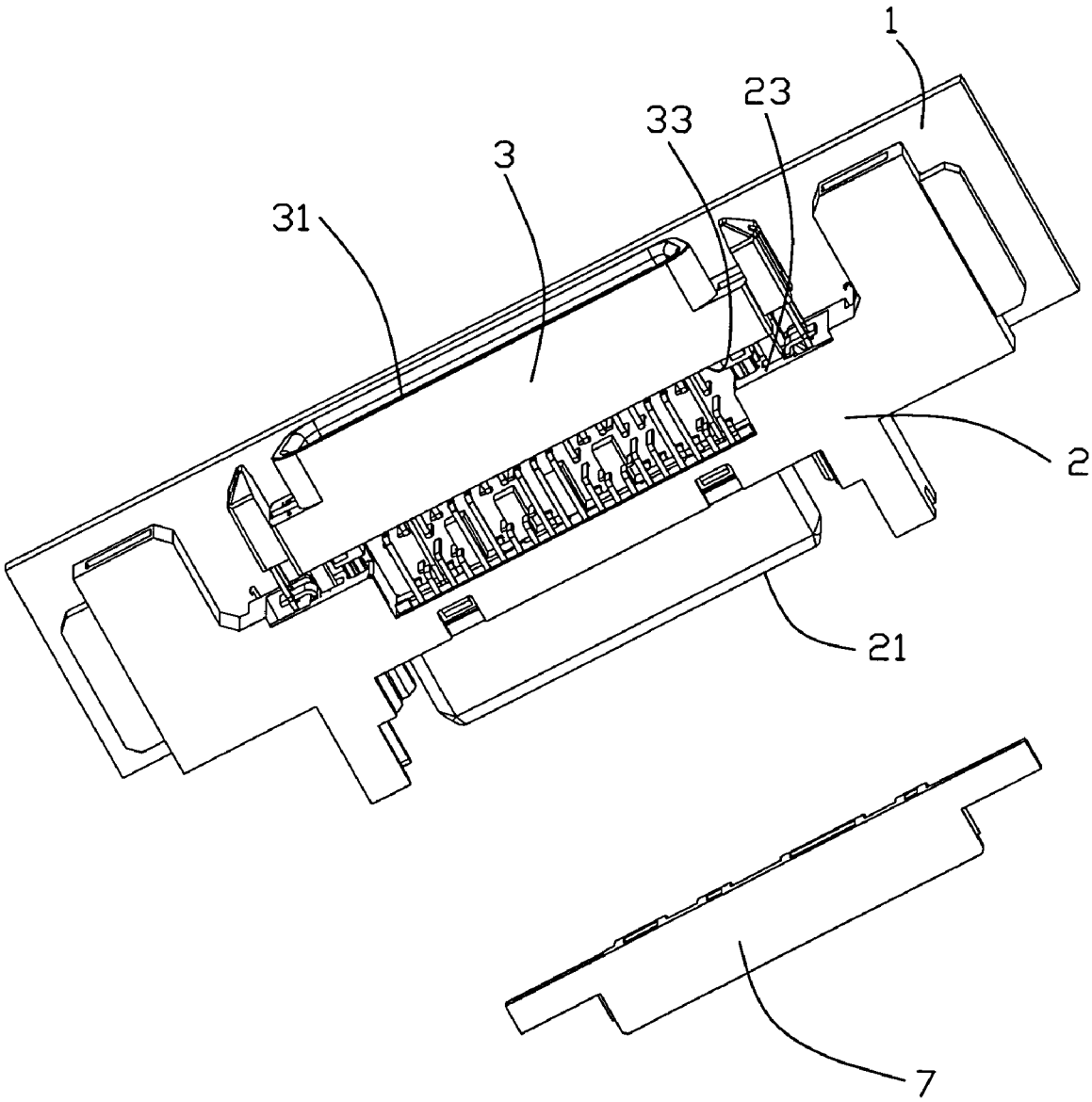
FIG. 3 is another perspective view of the interconnection system of FIG. 2, but with a protective cover removed therefrom.
Figure 4:
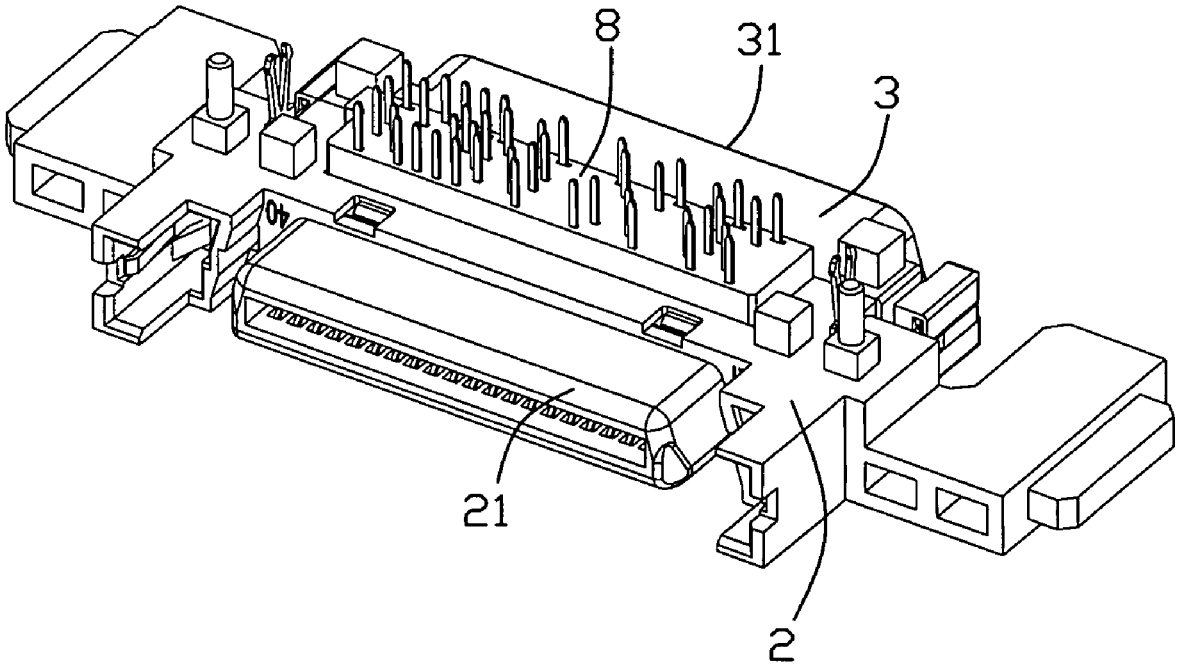
FIG. 4 is another perspective view of an electrical connector assembly of the interconnection system of FIG. 2.
Figure 5:
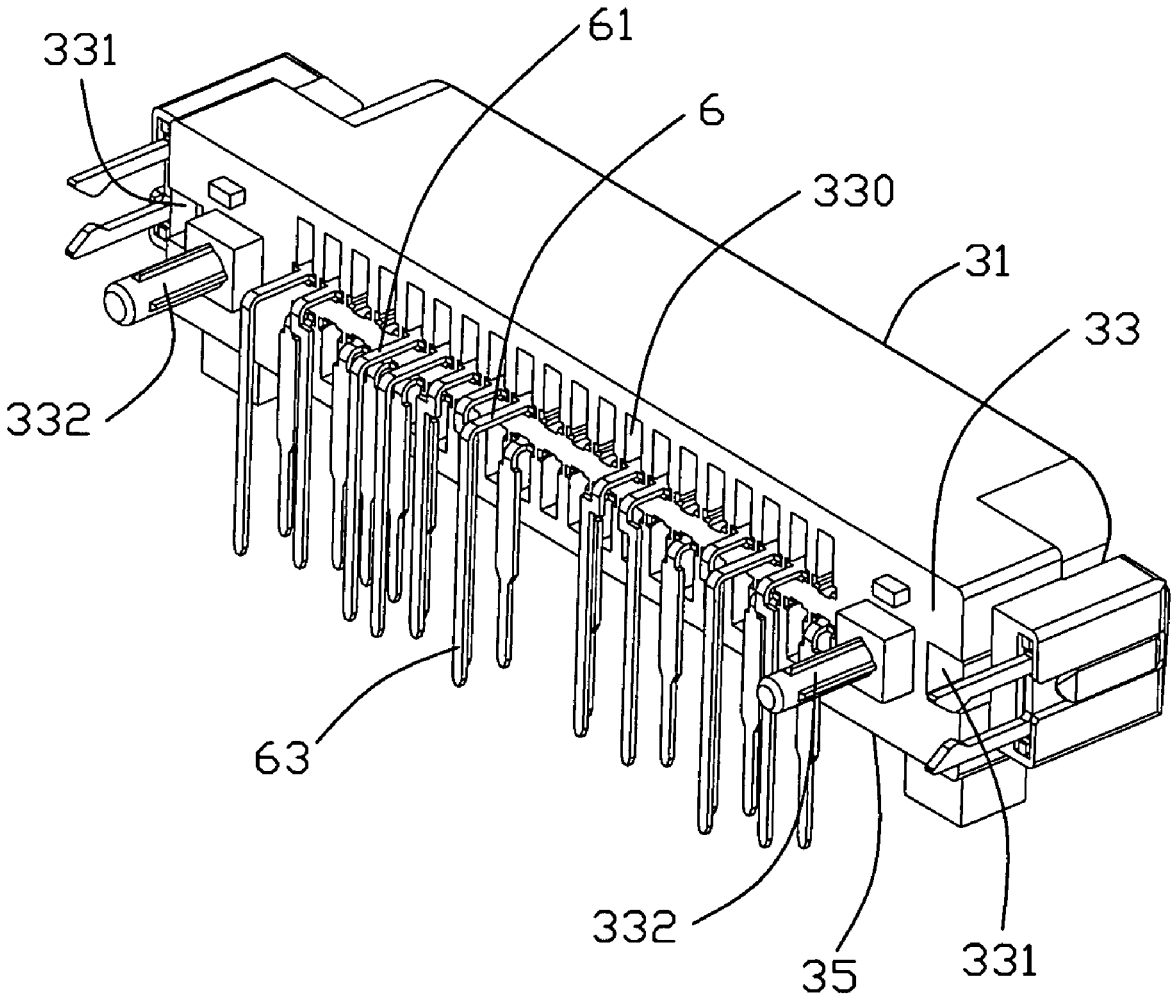
FIG. 5 is a perspective view of a first connector of the electrical connector assembly of FIG. 2.
Figure 6:
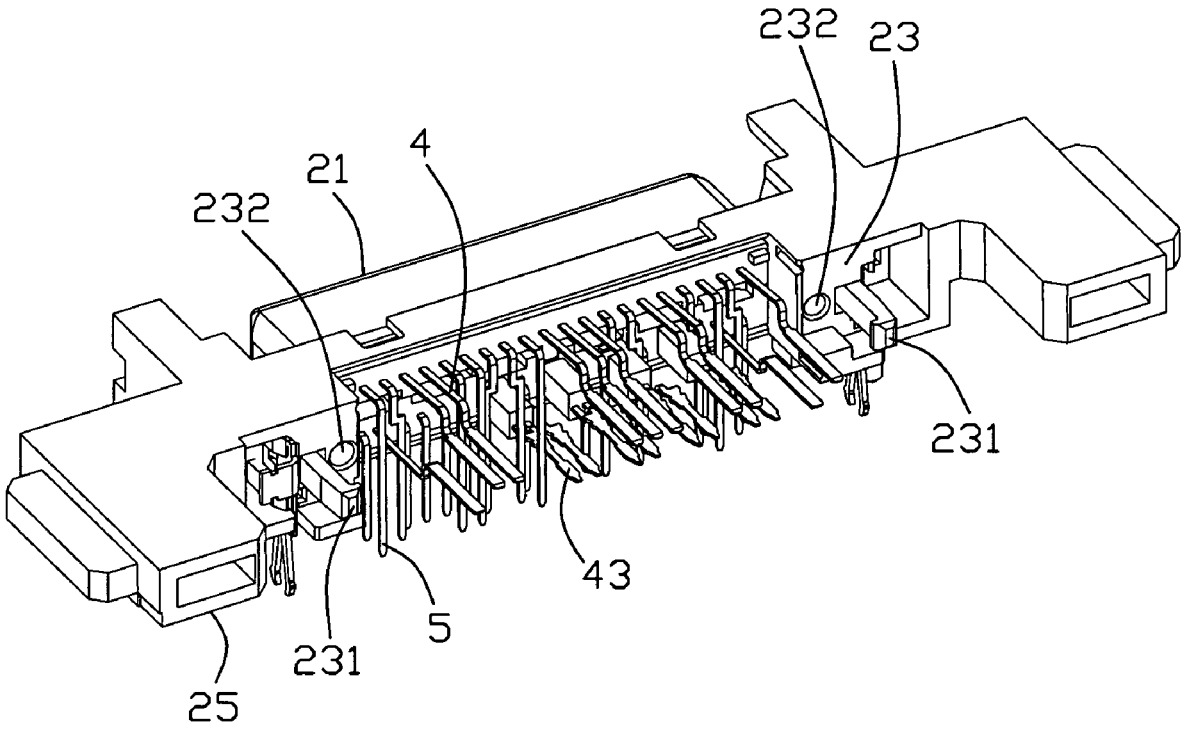
FIG. 6 is a perspective view of a second connector of the electrical connector assembly of FIG. 2.

Referring particularly to FIGS. 1 and 5-6, the female connector 2 includes a base having a female mating face 21 adapted to mate with a corresponding connector mounted on a hard disk drive (not shown), a first abutment face 23 opposite to the female mating face 21, and a female mounting face 25 disposed adjacent the printed circuit board 1 to extend between the female mating face 21 and the first abutment face 23. The male connector 3 also includes a body having a male mating face 31 opposite to the female mating face 21 and adapted to mate with a connector mounted on a backplane (not shown), a second abutment face 33 opposite to and spaced with a distance from the first abutment face 23, and a male mounting face 35. In this embodiment, the female mounting face 25 that is orthogonal to the female mating face 21 and the male mounting face 35 that is orthogonal to the male mating face 31 is disposed in a common place.

The electrical connector assembly comprises a first group of terminals 6, a second group of terminals 4 and a third group of terminals 5. Each terminal 6 within the first group which is arranged with the male connector 3 only includes a first male engaging section which is accessible from the male mating face 31, a first median section 61 extending in a direction from the male mating face 31 to the first abutment face 23, and a first tail section 63 extending away from or parallel to the second abutment face 33. In this embodiment, the first group of terminals 6 may include power contact terminals and ground contact terminals, positions of which are determined by specifications of connectors.

Figure 7:
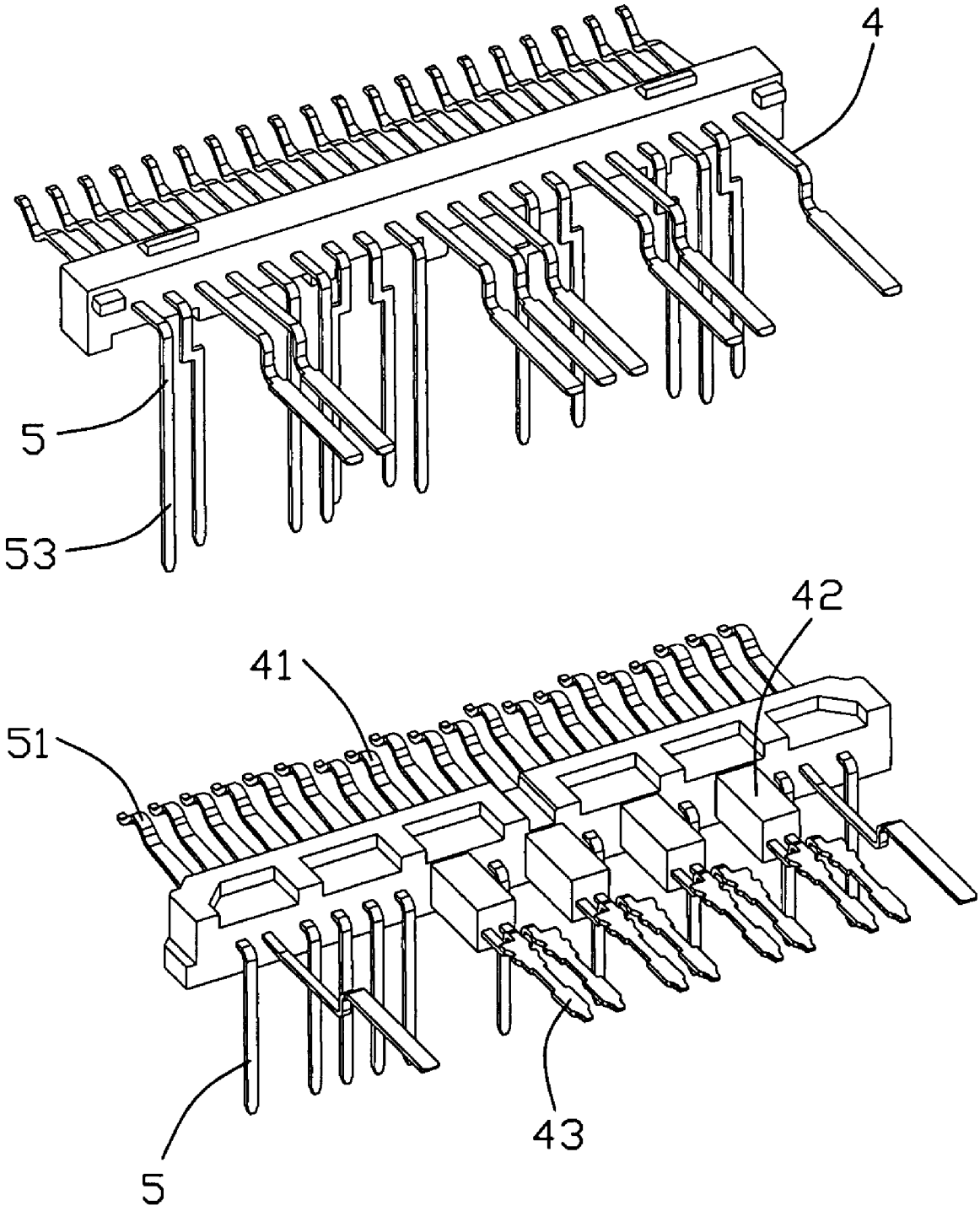
FIG. 7 is an exploded, perspective view of a contact terminal holding member of the second connector of FIG. 6.
Figure 8:
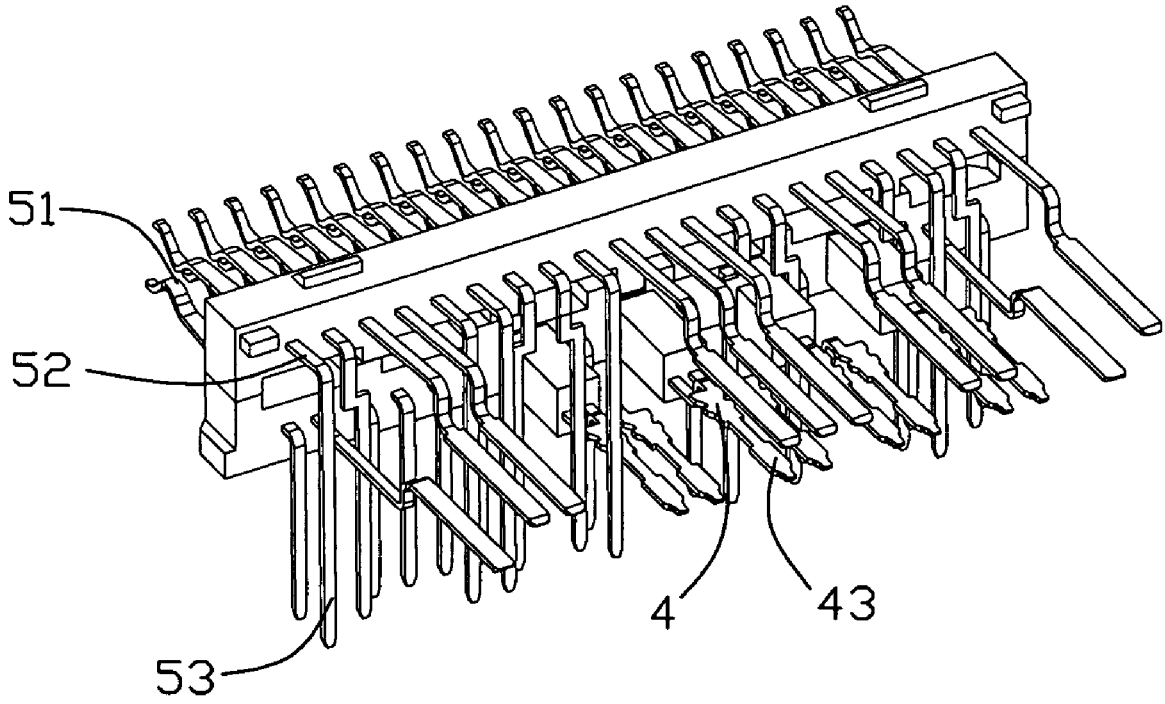
FIG. 8 is an assembled, perspective view of the contact terminal holding member of FIG. 7.
Figure 9:
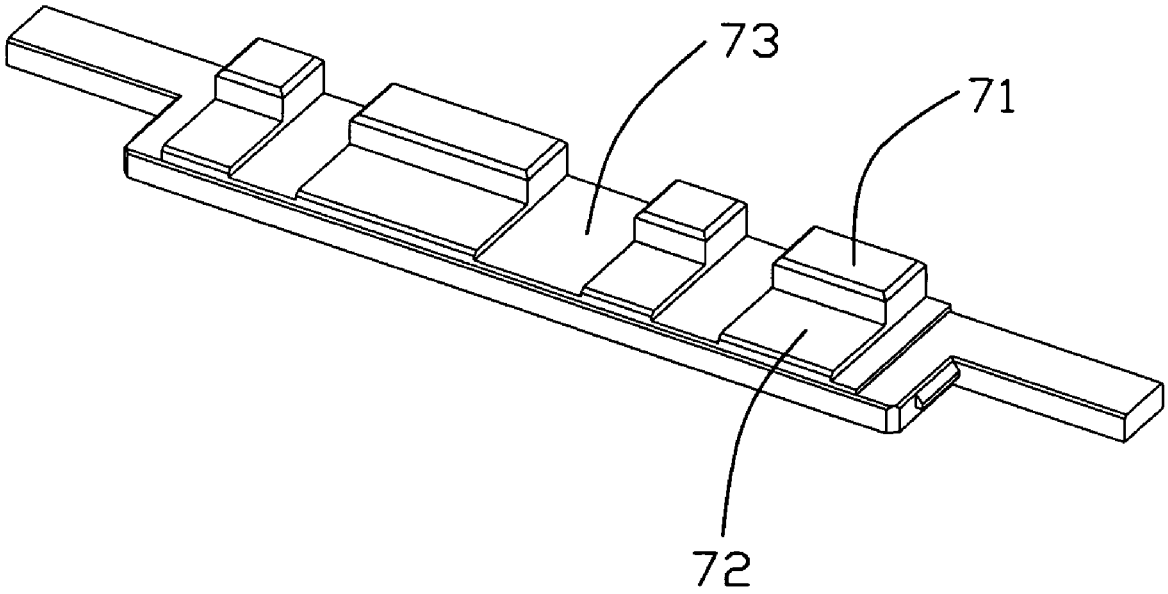
FIG. 9 is a perspective view of the protective cover.
Figure 10:
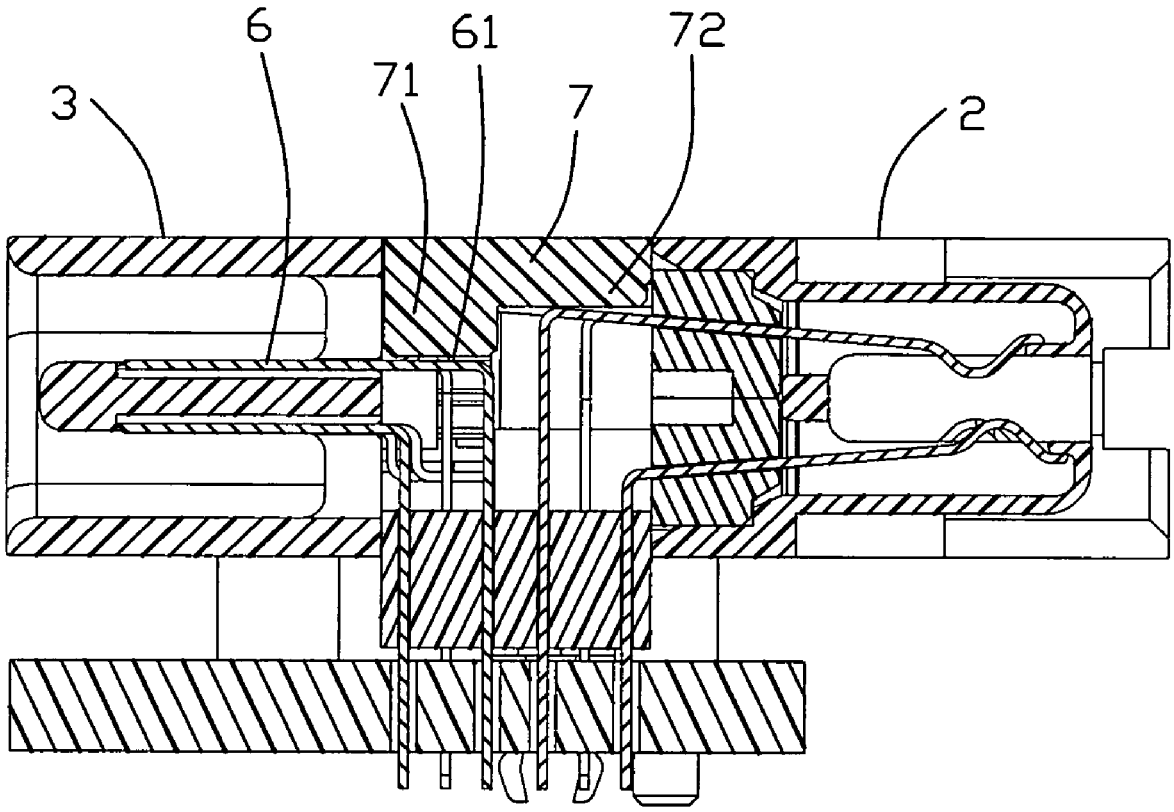
FIG. 10 is a cross sectional view of the connector assembly taken along broken lines 10-10 in FIG. 2.

A second group of terminals 4 extends in a direction from the female mating face 21 to the male mating face 31 so as to electrically connect the female connector 2 with the male connector 3. The second group of terminals 4 is of signal terminals for transmitting signal between the female connector 2 and the male connector 3. As shown in FIGS. 7 and 8, a selected number of signal terminals 4 has respective insulative segments 42 molded over portions of signal terminals adjacent the first abutment face 23 of the female connector 2 for controlling the impedances of the selected signal terminals 4 so as to enable the signal terminals 4 to be transmitted at a more high speed data rate. Each terminal 4 within the second group includes a second female engaging section 41 adjacent the female mating face 21 for engaging with respective contacts of the corresponding connector of the hard disk drive, and a second male engaging section 43 extending in the lengthwise direction and adjacent the male mating face 31 for engaging respective contacts of the connector of the backplane. The second abutment face 33 of the male connector 3 defines a plurality of male passageways 330, some of which receive the terminals 6 of the first group, others of which receive the terminals 4 from the second group of the female connector 2.

Each terminal 5 within the third group includes a third female engaging section 51 adjacent the female mating face 21 to be laterally or longitudinally aligned with the second female engaging section 41 of the terminals 4 of the second group, a third median section 52 extending in a direction from the female mating face 21 to the second abutment face 33, and a third tail section 53 extending parallel to the first abutment face 23 to be electrical connection to the printed circuit board 1, In this embodiment, the third group of terminals 5 may include power contact terminals and ground contact terminals, positions of which are determined by specifications of connectors.

Referring to FIGS. 1 and 5-6, the first abutment face 23 of the female connector 2 and the second abutment face 33 of the male connector 3 include interengaging elements extending therefrom for fastening the female connector 2 to the male connector 3. More specifically, the second abutment face 33 of the male connector 3 has a pair of indents 331 extending thereinto for latchably receiving inward latches 231 disposed adjacent two ends of the first abutment face 23 of the female connector 2, and a pair of alignment posts 332 extending outwardly therefrom for being engageably received within alignment slots 232 of the first abutment face 23, so as to have the male connector 3 and the female connector 2 assembled together.

Referring to FIGS. 1, 3 and 9-10, the connector assembly further includes a protective cover 7 disposed on a top region defined by the first abutment face and the second abutment face. The protective cover 7 defines a first projection 71 which abuts against the first median section 61 of the selected terminals 6, a second projection 72 which abuts against the third median section 52 of the selected terminals 5, and several passages 73 which penetrate through the first projection 71 and the second projection 72 so that the selected terminals 4 can get across. Therefore, the selected terminals 5 and 6 will not become deformed when mount the connector assembly to the printed circuit board 1.

In addition, the connector assembly further includes the middle spacer 8 on a bottom region between the female connector 2 and the male connector 3. A middle spacer 8 defines a plurality of through holes 80 for receiving the tail portions 63, 53 of the terminals 6, 5 to be penetrated therethrough so as to be electrical connection to the printed circuit board 1.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector assembly comprising:

a male connector comprising:

a connector body having a male mating face, a first abutment face and a first mounting face; and a plurality of first contacts each having a first male engaging section adjacent to the male mating face, a first median portion extending from the first engaging section and beyond said first abutment face, and a first tail portion extending towards the first mounting face;

a female connector comprising:

a connector body having a female mating face, a second abutment face opposite to and spaced with a distance from said first abutment face of the male connector, and a second mounting face; and a plurality of second contacts each having a first female engaging section adjacent to the female mating face, and a second male engaging section adjacent to the male mating face; and a protective cover of a single monolithic structure, having a portion disposed between said first abutment face and said second abutment face, said portion of the protective cover defining at least a first projection directly abutting against the first median section of at least one of the first contacts.

2. The electrical connector assembly as described in claim 1, wherein said female connector further comprises a plurality of third contacts having a third female engaging section adjacent to the female mating face, a third median portion extending from the third female engaging section and beyond said second abutment face, and the third tail portion extending towards the second mounting face.

3. The electrical connector assembly as described in claim 2, wherein said protective cover has a second projection directly abutting against the third median section of the selected third contact.

4. The electrical connector assembly as described in claim 3, wherein said protective cover further comprises passages, which penetrate through the first projection and the second projection.

5. The electrical connector assembly as described in claim 1, wherein the protective cover are detachably assembled on the connector bodies.

6. The electrical connector assembly as described in claim 1, further comprising a middle spacer disposed on a bottom region between the male connector and the female connector.

7. The electrical connector assembly as described in claim 1, wherein the body of the second connector includes an insulative segment disposed adjacent to said second abutment face to be molded over at least one of said second contacts.

8. The electrical connector assembly as described in claim 1, wherein the first and second connectors include interengaging elements on said opposite first and second abutment faces for engaging the male connector with the female connector.

9. An electrical connector assembly comprising:

first and second connector units intimately back to back arranged with each other, said first connector unit defining a first body with a first mating port facing toward a first horizontal direction and said second connector unit defining a second body with a second mating port facing toward a second horizontal direction opposite to said first horizontal direction;

a plurality of first contacts each having a first mating section exposed to the first mating port and a first board mount section extending in a vertical direction;

a plurality of second contacts each having a second mating section exposed to the second mating port and a second board mount section extending in said vertical direction;

a plurality of third contacts each having a first mating region exposed to the first mating port and a second mating region exposed in to the second mating port; and a monolithic protective cover discrete from while detachably attached to and located between the first body and the second body, and equipped with a structure to regulate and retain at least either the first contacts or the second contacts around joints of the corresponding board mount sections and mating sections.

10. The electrical connector assembly as claimed in claim 9, wherein a spacer is located between the first body and the second body under said protective cover and equipped with through holes for extension of the corresponding board mount sections therethrough.

11. The electrical connector assembly as claimed in claim 9, wherein the protective cover regulates and retains the first contacts, and the mating sections of the first contacts are inserted molded with a terminal module.

12. The electrical connector assembly as claimed in claim 11, wherein the first mating sections are deflectable during use.

13. The electrical connector assembly as claimed in claim 9, wherein said cover is dimensioned not to extend beyond the first and second connector units in both the first horizontal direction and the second horizontal direction and in a lateral direction perpendicular to said first horizontal direction, the second horizontal direction and said vertical direction.

14. The electrical connector assembly as claimed in claim 9, wherein the first body and the second body are assembled together by posts formed on one of said first body and said second body and retaining holes formed in the other.

* * * * *